US006167230A

United States Patent [19]

Kimura et al.

[11] Patent Number: 6,167,230

[45] Date of Patent: Dec. 26, 2000

[54] IMAGE FORMING APPARATUS AND IMAGE TRANSFERRING DEVICE THEREFOR

[75] Inventors: Takayuki Kimura; Shohji Hayashi; Yasuhiro Sagawa, all of Kanagawa; Satoru Uchida, Tokyo, all of Japan

[73] Assignee: Ricoh Company, Ltd., Tokyo, Japan

[21] Appl. No.: 09/431,276

[22] Filed: Nov. 1, 1999

[30] Foreign Application Priority Data

Oct. 31, 1998 [JP] Japan ..... 10-326107
Dec. 7, 1998 [JP] Japan ..... 10-347573

[51] Int. Cl.[7] ..... G03G 15/14

[52] U.S. Cl. ..... 399/315

[58] Field of Search ..... 399/315, 398; 271/900, 312

[56] References Cited

U.S. PATENT DOCUMENTS 4,914,737 4/1990 Amemiya et al. ..... 399/303

FOREIGN PATENT DOCUMENTS 8-234577 9/1996 Japan .
9-43996 2/1997 Japan .

*Primary Examiner*—William J. Royer
*Attorney, Agent, or Firm*—Oblon, Spivak, McClelland, Maier & Neustadt, P.C.

[57] ABSTRACT

A simple, low cost image forming apparatus for transferring a toner image from a photoconductive element, intermediate image transfer body or similar image carrier to a recording medium and an image transferring device therefor are disclosed. When a discharger for separating a paper or similar recording-medium from the image carrier is located on a path along which the surface of the image carrier moved away from an image transfer nip (in early moves for, e.g., layout reasons, the defective separation of the trailing edge of the paper is obviated which would scatter a toner image. The trailing edge of the paper is substantially prevented from jumping up and contacting a structural element included in the apparatus.

6 Claims, 9 Drawing Sheets

IMAGE FORMING APPARATUS AND IMAGE TRANSFERRING DEVICE THEREFOR

BACKGROUND OF THE INVENTION

The present invention relates to a copier, printer, facsimile apparatus or similar Image forming apparatus and an image transferring device therefore. More particularly, the present invention relates to an image forming apparatus of the type transferring a toner image from an intermediate image transfer body, photoconductive element or similar image carrier to a recording medium, and an image transferring device therefor.

Generally, an image forming apparatus is implemented as an electrophotographic copier, a printer, a facsimile apparatus or a multiplex machine having at least two of their functions. One of conventional image transferring devices for use in the image forming apparatus includes a pair of image transfer members sandwiching an image carrier and forming a nip for image transfer therebetween. This type of image transferring device separates a recording medium moved away from the above nip from the image carrier by using a curvature. However, to separate the recording medium by means of a curvature, the surface of the image carrier moved away from the nip must be steered to a degree capable of implementing the curvature. Therefore, the curvature separation scheme is not applicable to an image forming apparatus involving various limitations on layout, configuration of the image carrier, etc.

When the above curvature separation is not practicable, a discharger for separation may be located on a path along which the surface of the image carrier moved away from the image transfer nip linearly moves. This, however, brings about another problem that if the recording medium moved away from the image transfer nip is not immediately separated from the image carrier, toner transferred to the medium is apt to again deposit on the image carrier. Such redeposition of the toner on the image carrier would result in a defective image. This is particularly true with the trailing edge of the recording medium because discharge for separation is not always applied to the trailing edge due to the ON/OFF timing of a voltage assigned to the discharger.

Another problem with the conventional image transferring device is that when the trailing edge of the recording medium moves away from the nip or image transfer region, it is apt to jump up and contact a structural element included in the image forming apparatus. This disturbs the toner image carried on the image carrier, but not fixed, or causes toner to deposit on and smear the trailing edge of the recording medium. Particularly, when the recording medium has a high resistance or a low water content, the medium is easy to charge and causes its trailing edge to be easily electrostatically attracted by the image carrier and jump up.

To solve the above jump problem, a voltage opposite in polarity to the image transfer voltage may be applied to the image transferring device when the trailing edge of the recording medium moves away from the nip, as proposed in the past. Alternatively, a voltage applying device may be interposed between the image transferring device and the separating device for applying a charge opposite in polarity to the image transfer voltage to the trailing edge of the recording medium moved away from the nip, as also proposed in the past. However, the former scheme has a problem that the toner of the toner image transferred to the recording medium is partly electrostatically returned to the image carrier, degrading the quality of the toner image. The latter scheme has a drawback that the voltage applying means makes the construction of the image forming apparatus sophisticated and increases the cost.

Technologies relating to the present invention are disclosed in, e.g., Japanese Patent Laid-Open Publication Nos. 8-234577 and 9-43996.

SUMMARY OF THE INVENTION

It is therefore a first object of the present invention to provide an image transferring device capable of obviating the defective separation of the trailing edge of a recording medium even when a discharger for separating the medium from an image carrier is located on a path along which the surface of the image carrier moved away from an image transfer nip linearly moves for, e.g., layout reasons, and an image forming apparatus including the same.

It is second object of the present invention to provide an image forming apparatus capable of obviating or reducing the jump of the trailing edge of a recording medium with a simple configuration, and an image transferring device therefor.

In accordance with the present invention, an image transferring device includes a pair of image transfer members sandwiching an image carrier and forming a nip therebetween, a discharger for separating a recording medium from the image carrier at a separating position on a path along which the surface of the image carrier moved away from the nip linearly moves, a power source for applying a voltage to the discharger, and a controller for causing the power source to continuously apply the voltage to the discharger until the trailing edge of the medium moved away from the nip moves away from the separating position.

Also, in accordance with the present invention, the above image transferring device arranged in an image forming apparatus including a latent image carrier, a latent image forming device for forming a latent image on the latent image carrier, a developing device for developing the latent image to thereby produce a corresponding toner image, an intermediate image transfer body to which the latent image is transferred from the latent image carrier, a first image transferring device for transferring the toner image from the latent image carrier to the intermediate image transfer body, and a second image transferring device for transferring the toner image from the intermediate transfer body do a recording medium.

The image forming apparatus may be of the type not including the intermediate image transfer body.

Further, in accordance with the present invention, an image forming apparatus includes an image carrier having a surface movable while carrying a toner image thereon. An image transferring device is applied with an image transfer voltage opposite in polarity to a charge deposited on the toner image for electrostatically transferring the toner image from the image carrier to a recording medium. A separating device is applied with a separation voltage of the same polarity as the charge of the toner image for discharging or reducing a charge deposited on the recording medium by the image transferring device to thereby separate the medium from the surface of the image carrier. A separation voltage controller controls the application of the separation voltage to the separating device such that the application is interrupted after the trailing edge of the recording medium has reached a position corresponding to the separating device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
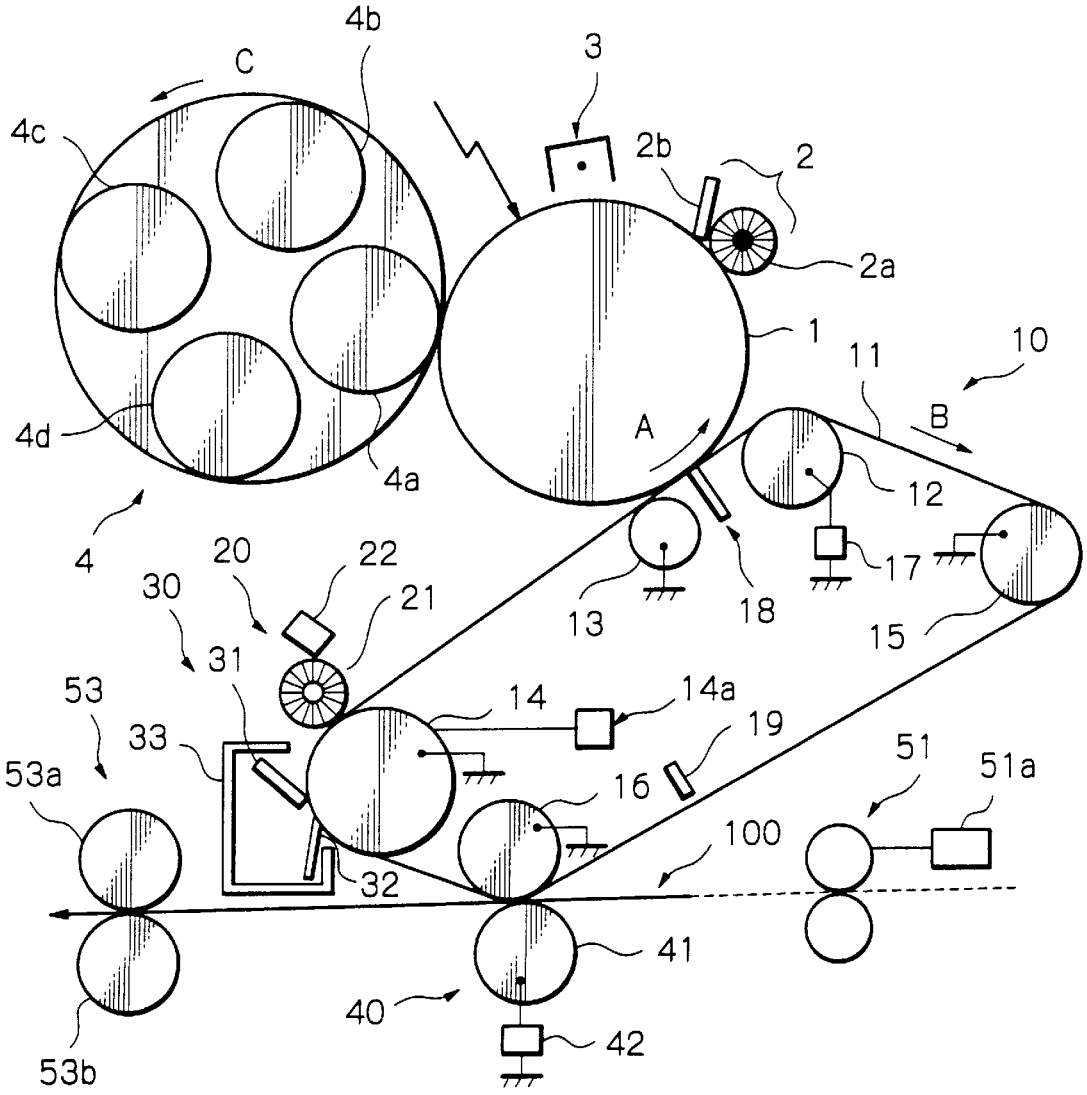
FIG. 1 is a view showing an image forming apparatus embodying the present invention.

Preferred embodiments of the image forming apparatus and image transferring device therefor in accordance with the present invention will be described hereinafter. It is to be noted that identical reference numerals used in the illustrative embodiments do not always designate identical structural elements.

An embodiment of the present invention to be described first is mainly directed toward the first object stated earlier. As shown in FIG. 1, an image forming apparatus embodying the present invention is implemented as full-color electrophotographic copier by way of example. The copier is generally made up of a color scanner or color image reading section and a color printer or color image recording section.

The color scanner includes a glass platen on which a document is laid. Optics including a lamp, mirrors and a lens focuses the image of the document on a color image sensor. The color image sensor reads the color image information of the document on a color basis, e.g., on an R (red), G (green) and B (blue) basis and outputs corresponding electric image signals. Specifically, the color image sensor includes RGB color separating means and CCDs (Charge Coupled Devices) or similar photoelectric transducers and is capable of reading the three colors at a time. Ah image processing section transforms the R, G and B image signals to Y (yellow), M (magenta), C (cyan) and BK (black) color image data on the basis of the intensity of the signal. More specifically, the optics scans the document in response to a start signal related to the printer, thereby outputting color image data. In the illustrative embodiment, image data of one color is output by a single scanning operation of the optics, so that Y, M, C and BK data are output by four consecutive scanning operations of the optics.

The printer includes a photoconductive element or latent image carrier 1 as well as an optical writing unit or exposing means not shown. The drum 1 is uniformly charged to negative polarity beforehand. The optical writing unit converts the color image data received from the scanner to an optical signal and forms a negative latent image representative of the document image on the drum 1 with the optical signal. The writing unit may include a semiconductor laser, an emission drive controller for controllably driving the laser, a polygonal mirror, a motor for rotating the polygonal mirror, an f/θ lens and a mirror. The drum 1 is rotatable counterclockwise, as indicated by an arrow A in FIG. 1.

Arranged around the drum 1 are a drum cleaning device or cleaning means 2, charger or charging means 3, a revolver type rotary developing device or developing means (revolver hereinafter) 4, and an intermediate image transfer unit or image transferring means 10. The drum cleaning device 2 includes a fur brush 2*a* and a blade 2*b* for cleaning the surface of the drum 1 after primary transfer which will be described specifically later. The charger 3 uniformly charges the cleaned surface of the drum 1 to negative polarity.

The revolver 4 includes a plurality of developing sections, i.e., a BK developing section 4*a* an M developing section 4*b*, a C developing section 4*c*, and a Y developing section 4*d*, and a plurality of toner containers, not shown, respectively corresponding to the developing sections 4*a*–4*d*. The revolver 4 is rotatable to bring any one of the developing sections 4*a*–4*d* to a developing position where the developing section faces the drum 1. In FIG. 1, the BK developing section 4*a* is shown as being located at the developing position. The developing sections 4*a*–4*d* each include a paddle or agitating means for agitating a developer while scooping it up, a toner content sensor or sensing means responsive to the toner content of the developer, and a developing sleeve or developer carrier for causing the developer deposited thereon to contact the drum 1. The four developing sections 4*a*–4*c* are identical in configuration with each other.

The developers stored in the developing sections 4*a*–4*d* each are implemented by a two-ingredient type developer; toner in each developer is charged to negative polarity. When the toner content of the developer stored in any one of the developing sections 4*a*–4*d* decreases due to consumption, the toner content sensor senses the decrease. In response to the resulting output of the toner content sensor, a toner replenishing device replenishes toner from a toner bottle, which is a specific form of the toner container, to the developing section. As a result, the toner content of the developer is successfully maintained constant.

The intermediate image transfer unit 10 includes an intermediate image transfer belt or image carrier 11. The belt 11 is passed over a bias roller for primary transfer or charge applying means 12, a ground roller or pretransfer discharging means 13, a drive roller or belt driving means 14, a tension roller 15, and a counter roller 16 for secondary transfer. A power source for primary transfer 17 is connected to the bias roller 12. A drive motor 14*a* is drivably connected to the drive roller 14 operable under the control of a controller or control means not shown. The rollers 12–16 over which the belt 11 is passed are formed of a conductive material. All the rollers other than the bias roller 12 are connected to ground.

The drum or latent image carrier 1 and belt or image carrier 11 contact each other to form a nip or primary image transfer region therebetween. The bias roller 12 adjoins the portion of the belt 11 downstream of the above primary image transfer region in a direction B in which the surface of the belt 11 moves (direction of belt rotation B hereinafter). The power source 17 applies a bias for primary transfer to the bias roller 12. The ground roller 13 connected to ground is located in the vicinity of the portion of the belt 11 upstream of the primary image transfer region in the direction of belt rotation B. The bias roller 12 and ground roller 13 press the belt 11 against the drum 1, so that the above nip is formed between the belt 11 and the drum 1.

The belt 11 has a laminate structure made up of a surface layer, an intermediate layer, and a base layer. The belt 11 is positioned such that the surface layer or outermost layer contacts the drum 1 while the base layer constitutes the innermost layer. An adhesive layer intervenes between the intermediate layer and the base layer. The belt 11 has a medium volume resistivity ρv of about $10^{11}$ Ωcm, as measured by a method prescribed by JIS (Japanese Industrial Standards) K6911. While a belt having a volume resistivity ρv of $10^{12}$ Ωcm or above can effectively prevent the toner from being scattered during image transfer, such a belt must be discharged after secondary transfer. Further, although use may be made of a belt having a volume resistivity ρv of $10^{14}$ Ωcm or above, it is not feasible for the above application from, e.g., the durability standpoint. The surface layer of the belt 11 has a surface resistivity of about $10^{13}$ Ωcm/$^2$.

Reinforcing members are fitted on opposite edges of the rear of the belt 11 in the widthwise direction of the belt 11 in order to prevent the belt 11 from twisting or otherwise deforming. The reinforcing members, however, sometimes form a gap between the edge portions of the belt 11 and the drum 1 during primary transfer. In light of this, a backup member 18 is held in contact with the edge portions of the rear of the belt 11 in such a manner as to fill up the above gap.

The intermediate image transfer unit 10 additionally includes a mark sensor or rotational position sensing means 19 for sensing marks provided on the rear of the belt 11, i.e., the rotational position of the belt 11. The mark sensor 19 is connected to the previously mentioned controller and allows the controller to recognize the position of an image formed on the belt 11.

Arranged around the belt 11 are a lubricant applying device or applying means 20, a belt cleaning unit or belt cleaning means 30, and an image transferring unit or secondary image transferring means 40. The brush roller 20, belt cleaning unit 30 and image transferring unit 40 each are movable into and out of contact with the belt 11.

The lubricant applying device 20 includes a brush roller 21 and a case 22 storing a solid lubricant and a spring not shown. For the solid lubricant use may be made of fine particles of zinc stearate molded in the form of a plate. The spring constantly biases the solid lubricant toward the brush roller 21, so that the lubricant remains in contact with the roller 21. Drive means, not shown, is drivably connected to the brush roller 21. After secondary image transfer, the brush roller 21 is rotated to shave off the solid lubricant and applies it to the belt 11 in the form of powder. At this instant, the brush roller 21 is rotated such that its portion contacting the belt 11 moves in the same direction as the belt 11 in order to prevent its bristles from collapsing. Also, in an applying region where the brush roller 21 and belt 11 contact each other, the brush roller 21 is caused to move at a higher linear velocity than the belt 11.

The belt cleaning device 30 includes a blade or cleaning member 31, an inlet seal member or sealing means 32, and a casing 33. Toner shaved off from the belt 11 by the blade 31 is collected in the casing 33. The inlet seal 32 guides the toner into the casing 33 so as to prevent it from flying about in the copier.

Figure 2:
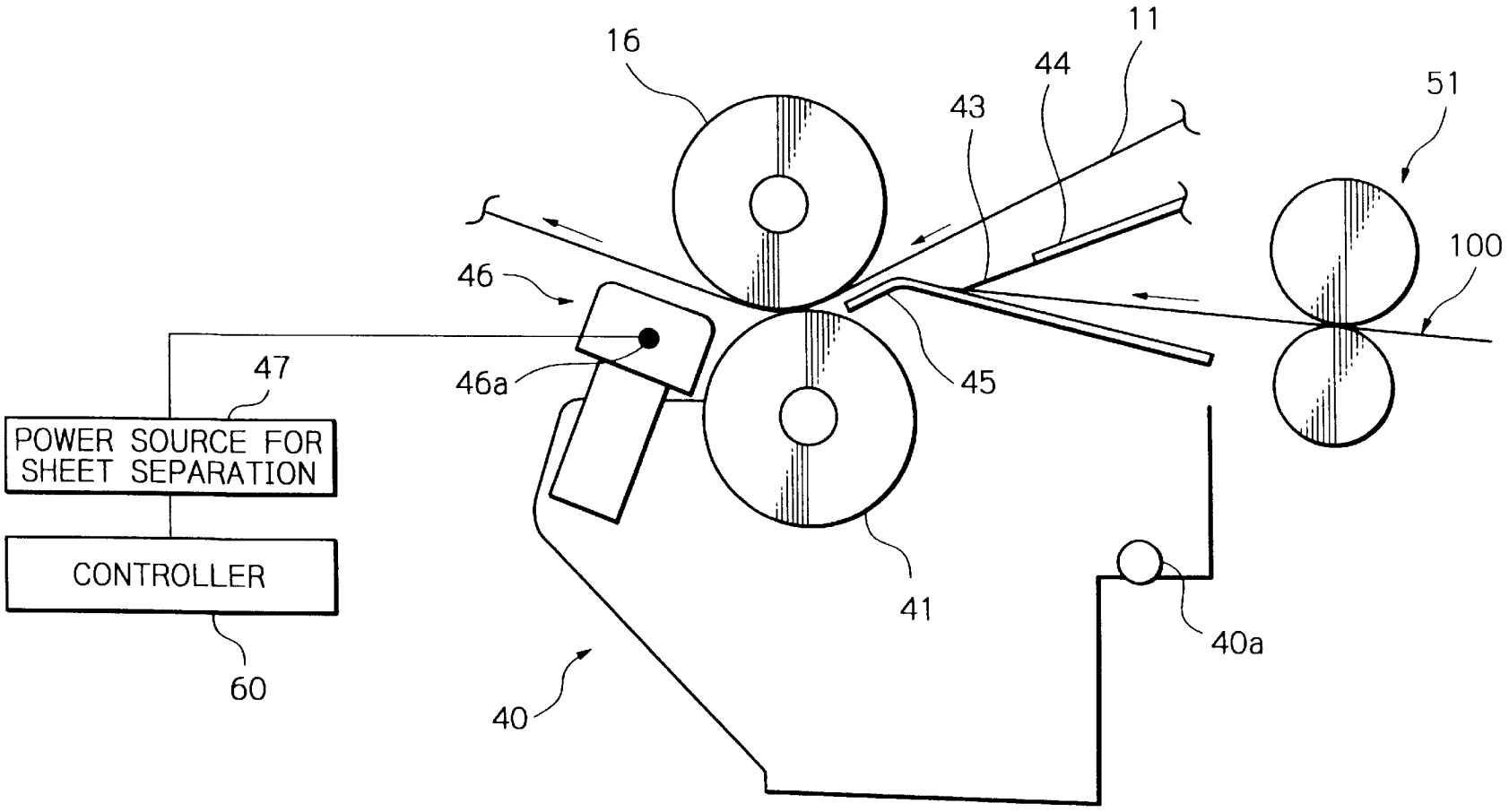
FIG. 2 is a fragmentary enlarged view of a secondary image transfer section included in the illustrative embodiment.

FIG. 2 shows the secondary image transfer unit 40 more specifically. As shown, the unit 40 includes a bias roller 41 for secondary image transfer facing the counter roller 16 of the intermediate image transfer unit. A power source 42 (see FIG. 1) for secondary image transfer is connected to the bias roller 41. A lower guide 45 is located upstream of a nip for secondary image transfer, which will be described later, in a direction in which a paper or similar recording medium 100 is conveyed (direction of paper conveyance hereinafter), and guides the lower surface of the paper 100. A charger or separation discharger 46 separates the paper 100 moved away from the above nip from the belt 11. A power source 47 applies an AC voltage, e.g., 6.7 kVp-p (peak-to-peak) to a discharge wire 46*a* included in the charger 48. An upper guide 43 is positioned upstream of the nip in the direction of paper conveyance and guides the upper surface of the paper 100. The upper guide 43 is mounted on a support member 43 affixed to the copier body.

The bias roller 41 and counter roller 16 for secondary transfer form the nip for secondary transfer or secondary image transfer region. At the time of image transfer from the belt 11 to the paper 100 effected at the nip, the power source 42 applies a bias for secondary image transfer to the bias roller 41. When a drive force is transmitted to the secondary transfer unit 40 via a clutch, not shown, the unit 40 rotates about a shaft 40*a* into or out of contact with the portion of the belt 11 supported by the counter roller 15. The power source 47 and clutch are connected to a controller or control means 60 and ON/OFF controlled thereby.

The printer includes a pair of registration rollers 51 located on the upstream side of a paper transport path with respect to the secondary image transfer region. The registration rollers 51 drive the paper 100 in accordance with a signal output from the controller 60 at such a timing that the paper 100 meets the toner image formed on the belt 11 at the secondary image transfer region. The paper 100 may be fed from one of a plurality of cassettes each storing a stack of papers of particular size or from a manual feed tray assigned to thick sheets, OHP (Over Head Projector) sheets and other special sheets.

The printer additionally includes a conveyor unit, not shown a fixing unit or fixing means 53 (see FIG. 1), and a copy tray not shown. The fixing unit 53 includes a heat roller 53*a* and a press roller 53*b* contacting each other. The heat roller 53*a* is controlled to a preselected fixing temperature. The heat roller 53*a* and press roller 53*a* cooperate to fix the toner image on the paper 100 with heat and pressure.

The controller 60 controls the movement of the brush roller 21 and blade 31 into and out of contact with the belt 11, the intensity of the bias to be applied form the power source 17, the rotation speed of the drive motor 14*a*, and the voltage to be applied to the charger 46.

The general operation of the above copier will be described hereinafter on the assumption that development occurs in the order of BK, C, M and Y. Of course, this order is only illustrative.

First, the copier starts forming a BK toner image, as follows. The color scanner reads color information out of a document and outputs BK image data first. The optical writing unit of the printer forms a BK latent image on the drum 1 by scanning the drum 1 with a laser beam in accordance with the BK image data. The BK developing section 4*a* develops the BK latent image with BK toner to thereby form a BK toner image. To surely develop the BK latent image, the revolver 4 is rotated to locate the developing section 4*a* at the developing position before the leading edge of the BK latent image arrives at the developing position. As a result, when the leading edge of the BK latent image arrives at the developing position, the developing section 4*a* is capable of surely developing the BK latent image with its developer held in an operative condition. After the trailing edge of the BK latent image has moved away from the developing position, the developer on the sleeve is immediately brought into an inoperative condition. This is completed at least before the leading edge of a C latent image to be developed next arrives at the developing position. To render the developer on the developing sleeve inoperative, the sleeve may be rotated in the direction opposite to the direction assigned to development.

The BK toner image is transferred from the drum 1 to the belt 11 moving at the same speed as the drum 1 (primary transfer).

In parallel with the above primary transfer of the BK toner image, the color scanner again reads the document at a preselected timing and outputs C image data. The optical writing unit forms a C latent image with a laser beam in accordance with the C image data. The developing section 4*c* develops the C latent image to thereby form a C toner image. The developing sleeve of the developing section 4*c* starts rotating after the trailing edge of the BK latent image has moved away from the developing position, but before the leading edge of the C latent image arrives at the developing position. As soon as the trailing edge of the C latent image moves away from the developing position, the developer on the developing sleeve of the developing section 4*c* is brought into an inoperative condition. This is completed before the leading edge of an M latent image to be developed next arrives at the developing position. The C toner image is transferred from the drum 1 to the belt 11 in accurate register with the BK toner image existing on the belt 11.

The above procedure is repeated with an M latent image and a Y latent image. In this manner, a BK, a C, an M and a Y toner image are sequentially transferred from the drum 1 to the belt 11 on upon the other, forming a full-color image (primary transfer).

During the interval between the primary transfer of the first or BK toner image and the primary transfer of the fourth or Y toner image, moving mechanisms, not shown, maintain the brush roller 21, blade 31, inlet seal member 32 and bias roller 41 spaced from the belt 11.

The belt 11 conveys the full-color image transferred thereto to the secondary image transfer region. Usually, the moving mechanism assigned to the bias roller 41 moves the bias roller 41 into contact with the belt 11 at such a timing that the toner image is transferred from the belt 11 to the paper 100. Subsequently, the power source 42 applies a bias for secondary image transfer to the bias roller 41, forming an electric field in the secondary image transfer region. As a result, the toner image is transferred from the belt 11 to the paper 100 (secondary transfer). The paper 100 is fed from a cassette selected on an operation panel, not shown, to the secondary image transfer region via the registration rollers 51 at the previously stated timing.

The conveyor unit conveys the paper 100 carrying the toner image thereon to the fixing unit 53. After the fixing unit 53 has fixed the toner image on the paper 100, the paper or copy 100 is driven out to the copy tray.

After the primary transfer, the drum cleaning device 2 removes the toner left on the drum 1, and then a discharge lamp or discharging means, not shown, discharges the surface of the drum 1. After the secondary transfer, the moving means assigned to the belt cleaning unit 30 presses the blade 31 and inlet seal member 32 against the belt 11 in order to clean the surface of the belt 11.

The secondary transfer of the full-color toner image from the drum 1 to the belt 11 characterizing the illustrative embodiment will be described more specifically with reference to FIG. 2. In the illustrative embodiment, before the secondary transfer, the secondary image transfer unit 40 is rotated clockwise about the shaft 40*a* in order to cause the bias roller 41 mounted thereon to form the secondary image transfer region or nip between it and the counter roller 16. The upper guide 43 and lower guide 45 guide the paper 100 fed at the preselected timing toward the inlet of the above nip. The power source 47 applies the previously mentioned AC voltage to the wire 46*a* of the charger 46.

The paper 100 moved away from the nip for secondary transfer is separated from the belt 11 at a separating position on the path along which the belt 11 linearly moves. The charger 47 with the wire 46*a* faces the belt 11 at the above separating position. In the illustrative embodiment, the controller 60 causes the power source 47 to continuously apply the AC voltage to the wire 46*a* until the trailing edge of the paper 100 moved away from the nip moves away from the separating position. After the paper 100 has moved away from the nip, the secondary image transfer unit 40 is rotated counterclockwise to release the bias roller 41 from the belt 11. This prevents the toner left on the belt 11 from smearing the surface of the bias roller 41. Further, the AC voltage continuously applied to the wire 46*a* over the above duration discharges the trailing edge of the paper 100 also, so that the trailing edge of the paper 100 can be surely separated from the belt 11 at the separating position. The paper 100 is therefore free from a defective image ascribable to the scattering of toner otherwise occurring at the trailing edge portion of the paper 100 due to defective image transfer.

While the above description has concentrated on an image transferring device for transferring a toner image from the belt 11 to the paper 100 and a copier including it, the illustrative embodiment is similarly applicable to an apparatus of the type directly transferring a toner image from, e.g., a photoconductive belt to a paper. The copier may, of course, be replaced with any other image forming apparatus, e.g., a laser printer.

Figure 3:
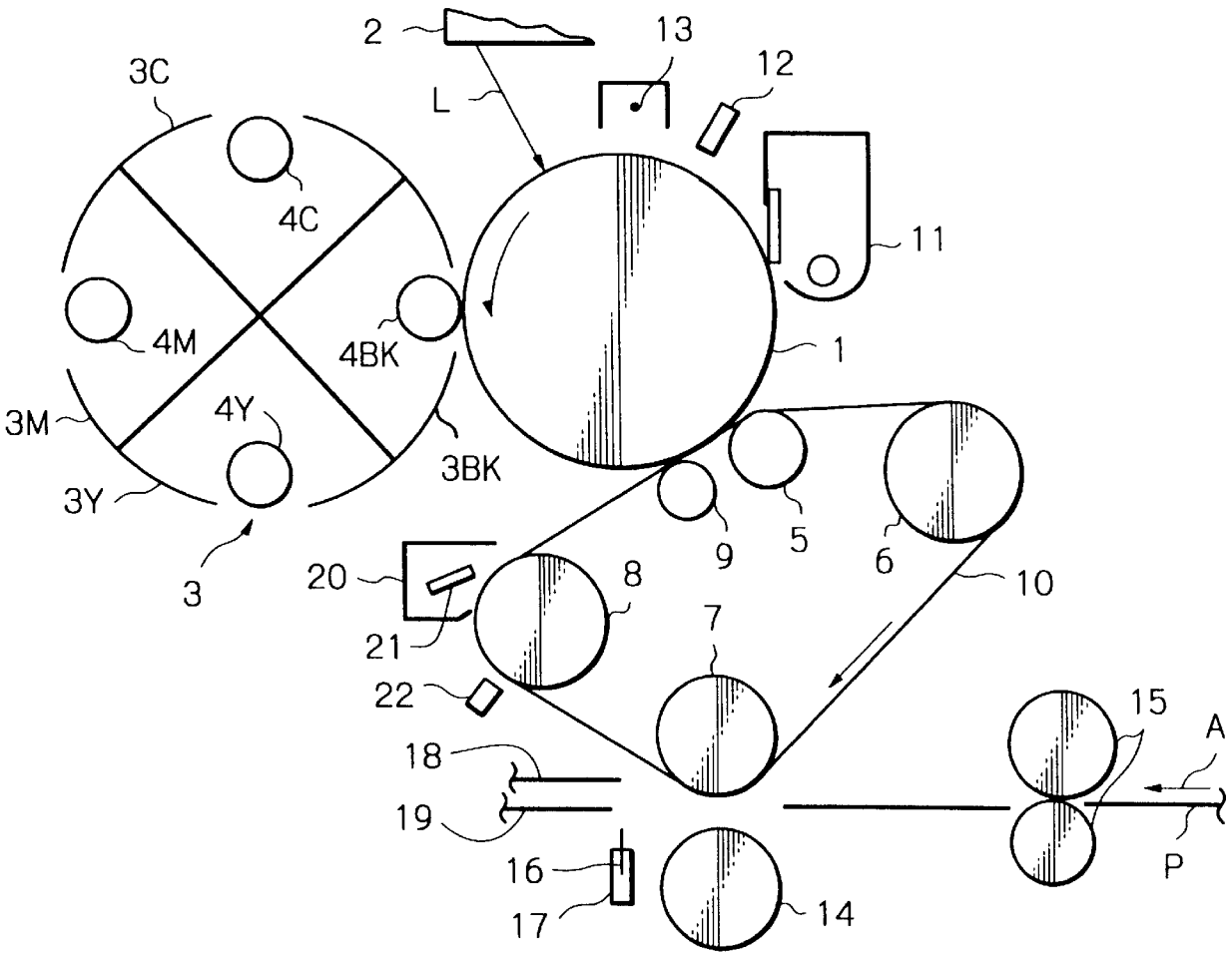
FIG. 3 is a view showing an alternative embodiment of the present invention.

An alternative embodiment of the present invention mainly directed toward the second object stated earlier will be described hereinafter. The alternative embodiment is implemented as a color image forming apparatus. As shown in FIG. 3, the color image forming apparatus includes a photoconductive drum or latent image carrier 1 rotatable counterclockwise, as indicated by an arrow. A main charger uniformly charges the surface of the drum 1 to a preselected polarity (negative polarity in the illustrative embodiment). A laser writing unit or exposing device 2 is arranged above the drum 1. The laser writing unit 2 scans the charged surface of the drum 1 with a laser beam L modulated in accordance with image data, thereby forming a latent image on the drum 1.

A revolver 3, which is a specific form of a developing unit, adjoins the drum 1 and includes developing sections 3BK, 3C, 3M and 3Y including developing rollers 4BK, 4C, 4M and 4Y, respectively. When the latent image formed first on the drum 1 is brought to the revolver 3, a first developing section, e.g., the black developing section 3BK is located at a developing position where it faces the drum 1. The developing roller 4BK develops the latent image with a BK developer, not shown, deposited thereon to thereby form a BK toner image. While developers of different colors stored in the developing sections 3BK, 3C, 3M and 3Y are two-ingredient type developers, i.e., toner and carrier mixtures, use may alternatively be made of one-ingredient type developers not containing a carrier. In the illustrative embodiment, the toner and carrier are respectively charged to negative polarity and positive polarity by friction; the toner develops the latent image by reversal development.

An intermediate image transfer body implemented as an endless flexible belt 10 is passed over a plurality of rollers 5–9 including a drive roller. The belt 10 runs in a direction indicated by an arrow in FIG. 3 while partly contacting the surface of the drum 1. The belt 10 moves at the same linear velocity and in the same direction as the drum 1, as seen at a position where the belt 10 and drum 1 contact each other. The BK toner image is transferred from the drum 10 to the belt 10. Specifically, in the illustrative embodiment, an image transfer voltage opposite in polarity to the charge of the toner deposited an the drum 1 is applied to the roller 5 facing the drum 1 with the intermediary of the belt 10. As a result, the toner image is transferred from the drum 1 to the belt 10.

A cleaning unit 11 removes the toner left on the drum 1 after the above image transfer. Subsequently, a discharge lamp 12 illuminates the surface of the drum 1 in order to reduce the absolute value of the surface potential thereof to a reference value.

Next, a second latent image, e.g., a C latent image is formed on the drum 1 in the same manner as the BK latent image. The revolver 3 is rotated to bring its second developing section or C developing section to the developing position. The developing roller 4C develops the C latent image with a D developer to thereby form a C toner image. The C toner image is transferred from the drum 1 to the belt 10 in accurate register with the BK toner image existing on the belt 10. Again, the surface of the drum 1 is cleaned by the cleaning unit 11 and then discharged by the discharge lamp 12.

The above procedure is sequentially repeated with a third or M latent image and a fourth or Y latent image so as to produce an M toner image and a Y toner image. At this time, the developing sections 3M and 3Y join in the development. The M and Y toner images are sequentially transferred from the drum 1 to the belt 10 one upon the other, completing a full-color image on the belt 10.

An image transfer roller or image transfer ring means 14 faces the roller 7 with the intermediary of the belt 10. In the condition shown in FIG. 3, the image transfer roller 14 is spaced from the surface of the belt 10.

Figure 4:
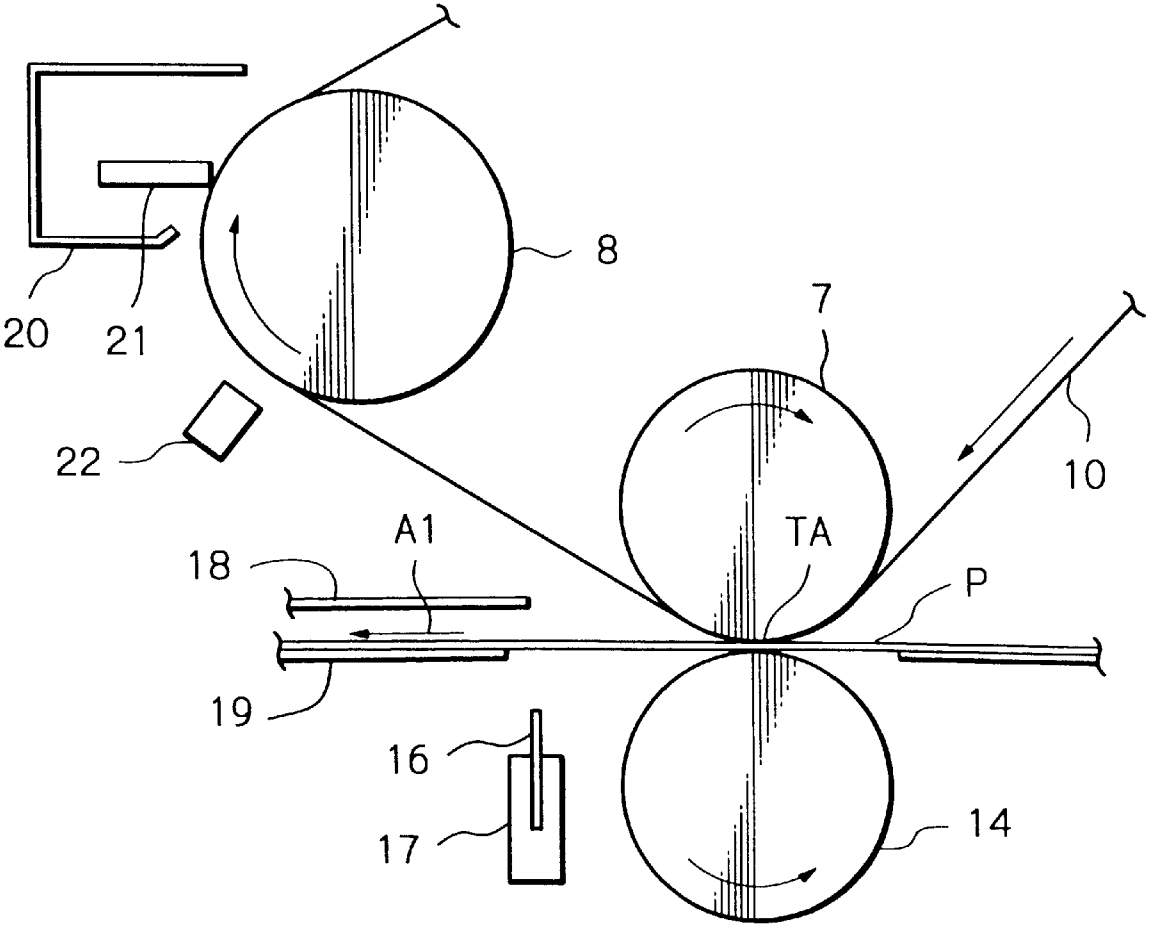
FIG. 4 is a view showing the alternative embodiment in a condition wherein a toner image is transferred from an intermediate image transfer body to a recording medium.

A paper, resin sheet or similar recording medium P (paper P hereinafter) is fed from a sheet feeding device, not shown, in a direction indicated by an arrow A in FIG. 3. A pair of registration rollers 15 convey the paper P at such a timing that the paper P meets the full-color toner image formed on the belt 10 at an image transferring position between the belt 10 and the image transfer roller 14. As shown in FIG. 4, the transfer roller 14 is brought into contact with the belt 1 substantially at the same time as the leading edge of the paper P reaches the image transferring position. At this instant, the roller 14 is caused to rotate counterclockwise, as viewed in FIG. 4, conveying the paper P in a direction A1 in cooperation with the belt 10.

In the above condition, an image transfer voltage opposite in polarity to the charge of the toner image formed on the belt 10 is applied to the surface of the image transfer roller 14. In the illustrative embodiment, this voltage is of positive polarity. The voltage forms an electric field causing the toner image to electrostatically move from the belt 10 toward the paper P between the paper P and the belt 10. As a result, the toner image is transferred from the belt 10 to the paper P. More specifically, in the illustrative embodiment, the roller 14 contacts the belt 10 with the intermediary of the paper P and forms a nip or image transfer region TA. The toner image is transferred from the belt 10 to the paper P at the image transfer region TA.

A discharge needle or separating means 16 adjoins the image transfer region TA at a position downstream of the image transfer region TA in the direction paper conveyance. The discharge needle 16 is supported by a holder 17 formed of an insulating material. The discharge needle 16 is spaced from the rear of the paper P opposite to the front of the same carrying the toner image. A separation voltage of the same polarity as the charge of the toner image, i.e., negative polarity in the illustrative embodiment is applied to the discharge needle 16. The resulting discharge from the needle 16 dissipates or reduces the positive charge deposited on the paper P by the image transfer roller 14 for promoting the separation of the paper P from the belt 10. Consequently, as shown in FIG. 4, the paper P is separated from the belt 10 and conveyed in the direction A1 while being guided by an upper guide 18 and a lower guide 19.

A fixing unit, not shown, is located downstream of the discharge needle in the direction of paper conveyance. When the paper P is brought to the fixing unit, the fixing unit fixes the toner image on the paper P with heat and pressure. Thereafter, the paper or copy P is driven out of the apparatus or steered to a duplex copy tray not shown. The paper P conveyed to the duplex copy tray is again fed to the registration rollers 15 face down, i.e., with the surface carrying the toner image facing downward. As a result, another toner image is transferred from the belt 10 to the other surface of the paper P. The resulting duplex copy P is driven out of the apparatus via the fixing unit.

After the secondary image transfer from the belt 10 to the paper P, a cleaning unit 20 removes the toner left on the belt 10 with a cleaning member 21. The cleaning member 21 is spaced from the belt 10 when the toner image formed in the belt 10 is repeatedly conveyed. That is, the cleaning member 21 is brought into contact with the belt 10 only after the full-color toner image has been transferred from the belt 10 to the paper P.

As stated above, in the illustrative embodiment, the belt 10 plays the role of an image carrier whose surface is movable while carrying a toner image thereon. The image transfer roller 14 plays the role of image transferring means for electrostatically transferring a toner image from the above image carrier to the paper P by being applied with a voltage opposite in polarity to the charge of the toner image. Further, the discharge needle 16 constitutes separating means applied with a voltage of the same polarity as the charge of the toner image for discharging or reducing the charge deposited on the paper P by the image transferring means, thereby separating the paper P from the image carrier.

If desired, the image transfer roller 14 may be replaced with a brush or a blade contacting the belt 10 with the intermediary of the paper P or even with a charger with a wire constantly spaced from the belt 10. In any case, the image transferring means is applied with a voltage opposite in polarity to the charge of the toner image for forming an electric field between the recording medium and the image carrier which electrostatically transfers the toner image from the belt 10 to the paper P.

The discharge needle 16 maybe replaced with any other suitable separating means, e.g., a discharge brush or a charge wire. In any case, the separating means is applied with a voltage of the same polarity as the charge of the toner image for dissipating or reducing, based on discharge, the charge deposited on the recording medium by the image transferring means, thereby promoting the separation of the medium from the image carrier.

The illustrative embodiment is similarly applicable to an image forming apparatus of the type directly transferring a toner image from a photoconductive element or similar latent image carrier to a recording medium with image transferring means and then separating the medium from the latent image carrier with separating means using discharge. In this case, the latent image carrier plays the role of the image carrier.

Figure 5:
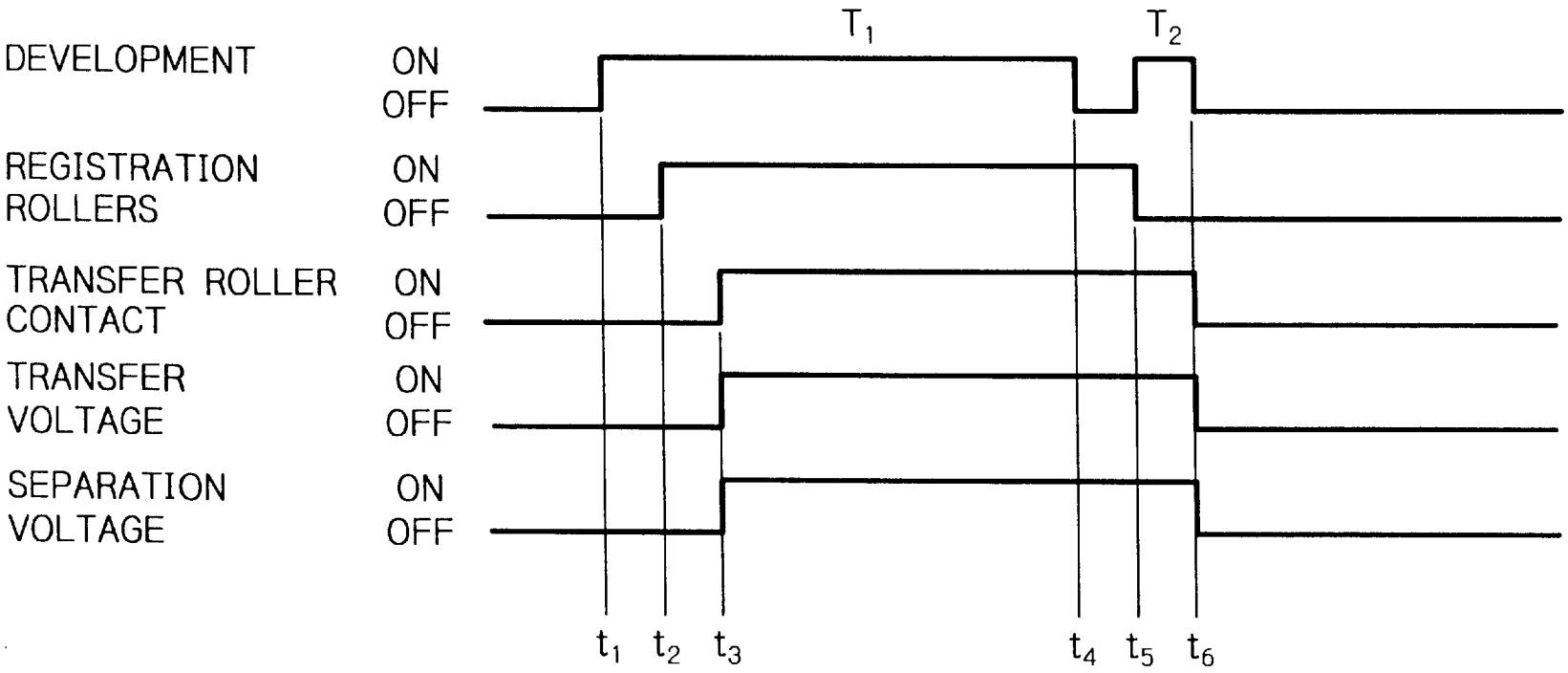
FIG. 5 is a timing chart demonstrating a specific operation of the alternative embodiment.

FIG. 5 is a timing chart representative of part of a specific operation available with the illustrative embodiment. As shown, the revolver 3 starts forming the fourth toner image, i.e., Y toner image on the drum 1 at a time $t_2$. The registration rollers 15 start rotating at a time $t_2$. At a time $t_3$, the image transfer roller 14 is brought into contact with the belt 10 with the intermediary of the paper P, and voltages are applied to the roller 14 and discharge needle 16. The revolver 3 ends the formation of the Y toner image at a time $t_4$. The registration rollers 15 stop rotating at a time $t_5$. At a time $t_6$, the image transfer roller 14 is released form the belt 10, as shown in FIG. 3, and the application of the voltages to the roller 14 and discharge needle 16 is interrupted.

In FIG. 5, $T_1$ is representative of the Y toner image formed on the drum 1 and then transferred to the belt 10 while $T_2$ is representative of a pattern toner image also formed on the drum 1 and then transferred to the belt 10. The pattern toner image $T_2$ will be described in detail later.

Now, the problem with a conventional image forming apparatus of the type described is that the trailing edge of the paper P carrying the toner image thereon is apt to jump up on moving away from the image transfer region, as stated earlier. This will be discussed more specifically with reference to FIGS. 6 and 7.

Figure 6:
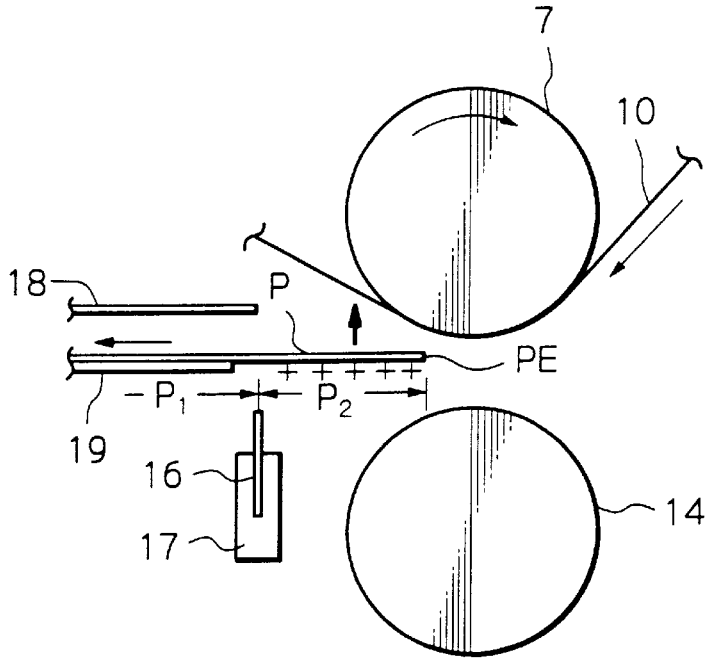
Fig. 6 PRIOR ART
FIGS. 6 and 7 are views showing a problem with a conventional image forming apparatus.
Figure 7:
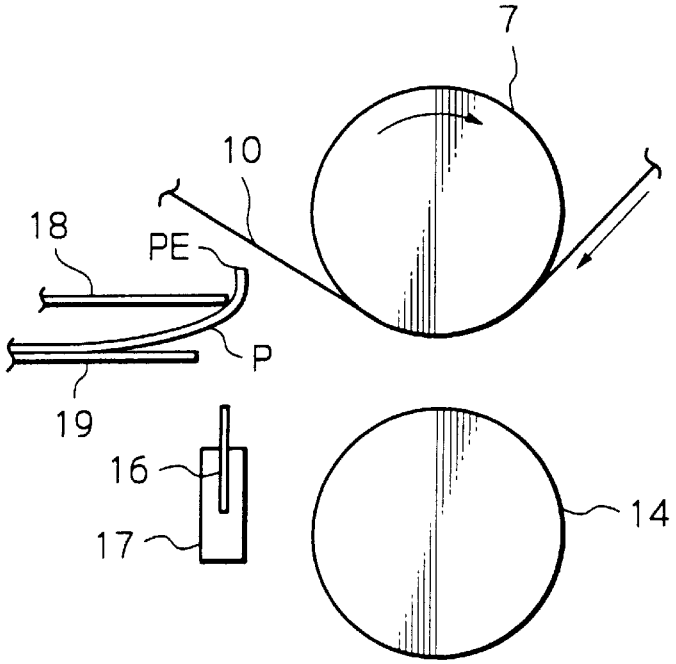
Fig. 7 PRIOR ART

As shown in FIG. 6, it is a common practice with an image forming apparatus to release the image transfer roller 14 from the belt 10 and to interrupt the voltage application to the roller 14 and discharge needle 14 as soon as the trailing edge PE of the paper P moves away from the image transfer region (see FIG. 4). At this instant, the part P, of the paper P downstream of the discharge needle 6 has its charge successfully discharged or reduced by the discharge needle 16. However, the other part $P_2$ of the paper P upstream of the discharge needle 16 still carries a great amount of positive charge deposited by the roller 14. As a result, as shown in FIG. 7, the part $P_2$ is electrostatically attracted by the belt 10 and jumps up. If the part $P_2$ so jumped up contacts, e.g., the guide member 18, the toner image carried on the paper P, but not fixed, is disturbed. In addition, the toner deposited on the guide member 18 is apt to deposit on the trailing edge PE of the paper P and smear it.

Assume that the paper P has a high resistance, that the water content of the paper P is low due to a low temperature, low humidity environment, or that the paper P is refed from the duplex copy tray and therefore has a low water content. Then, the paper P is easy to charge and therefore causes its trailing edge to noticeably jump up due to the electrostatic attraction of the belt 10. This is also true with an image forming apparatus not using an intermediate image transfer body.

In light of the above, when the trailing edge PE of the paper P moves away from the image transfer region, a voltage opposite in polarity to the voltage applied to the transfer roller 14, i.e., of the same polarity as the toner may be applied to the roller 14, as stated previously. This, however, brings about another problem that when the paper P has a low resistance, the above voltage is apt to reduce the toner holding force of the paper P and electrostatically transfer part of the toner to the belt 10.

Voltage applying means may be interposed between the image transfer roller 14 and the discharge needle 16 for depositing a charge opposite in polarity to the image transfer voltage on the trailing edge of the paper P, as also stated previously. This kind of scheme is not desirable because it makes the construction of the apparatus sophisticated and thereby increases the cost.

Figure 8:
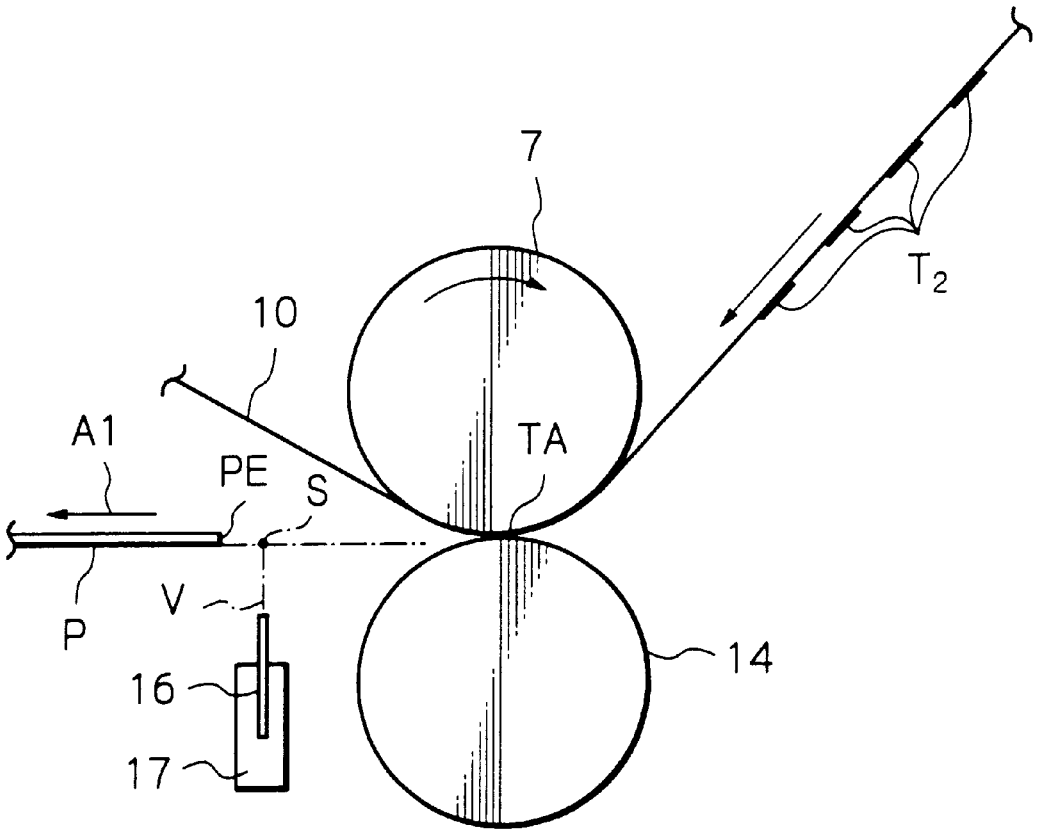
FIG. 8 is a view for describing a timing for interrupting the application of a separation voltage to a discharge needle included in the alternative embodiment.

As shown in FIG. 8, the illustrative embodiment includes separation voltage control means for interrupting the voltage application to the discharge needle 16 after the trailing edge PE of the paper P has reached the needle 16. In the specific procedure shown in FIG. 5, the voltage application to the image transfer roller 14 is interrupted at the same time as the interruption of the above voltage application.

Specifically, assume a line V extending from the tip of the discharge needle 16 perpendicularly to the paper P or the transport path assigned thereto, and a point S where the line V and the paper P or the transport path intersect each other. Then, in the illustrative embodiment, the voltage application to the discharge needle 16 is interrupted after the trailing edge PE of the paper P has reached the point S.

With the above scheme unique to the illustrative embodiment, it is possible to entirely remove or reduce the charge deposited on the paper P by the image transfer roller 14 on the basis of the discharge of the discharge needle 16. This obviates an occurrence that the voltage application to the discharge needle 16 is interrupted when a great amount of charge exists on the trailing edge of the paper P, as discussed with reference to FIG. 6. Consequently, the trailing edge of the paper P is successfully prevented from jumping up and contacting the guide member 18 or from being smeared by the toner, as shown in FIG. 7. Moreover, because a charge of the same polarity as the toner is not deposited on the paper P at all, the toner on the paper P is not electrostatically attracted by the belt 10. In addition, the apparatus is not complicated in constructed or increased on cost.

In the illustrative embodiment, when the toner images of different colors are sequentially formed on the drum 1, the pattern toner image mentioned earlier is formed at the rear of each toner image. The pattern toner image is of the same color as the toner image preceding it. Such pattern images are sequentially transferred form the drum 1 to the belt 10 et spaced positions in the direction of movement of the belt 10. A sensor 22 (see FIGS. 3 and 4) facing the belt 10 senses the density of each pattern toner image at a suitable timing. The sensor 22 is implemented by a reflection type photosensor by way of example.

More specifically, when the developing section 3BK forms the BK toner image on the drum 1, it also forms a BK pattern toner image on the drum 1 at a position upstream of the BK toner image in the direction in which the surface of the drum 1 moves. The BK pattern toner image is transferred from the drum 1 to the belt 10. The sensor 22 senses the density of the BK pattern toner image. If the image density sensed by the sensor 22 is short, then necessary control, e.g., the replenishment of fresh BK toner to the developing section 3BK is executed. Such a procedure is repeated to sequentially form a C, an M and a Y pattern toner image on the belt 10. As a result, the BK, C, M and Y pattern toners images spaced from each other are formed on the belt 10 upstream of the full-color image in the direction in which the surface of the belt 10 moves. In FIG. 5, $T_2$ is representative of the Y pattern toner image by way of example. Such pattern toner images may be formed every time a full-color image is formed on the belt 10 or every timer e.g., ten full-color images are formed.

The pattern toner images $T_2$ formed on the belt 10 must not be transferred to the paper P. The cleaning member 21 contacting the belt 10 removes the toner pattern images $T_2$ after the sensor 22 has sensed the images $T_2$. It is therefore necessary to release the image transfer roller 14 from the belt 10 such that after the transfer of the full-color image from the belt to the paper P, the pattern toner images $T_2$ arrive at the position between the belt 10 and the transfer roller 14 having been released from the belt 10. For example, as shown in FIG. 9, after the roller 14 has been released from the belt 10, the pattern toner images $T_2$ are conveyed via the position between the belt 10 and the roller 14, This prevents the toner forming the pattern toner images from depositing on the roller 14 or the paper P.

Figure 9:
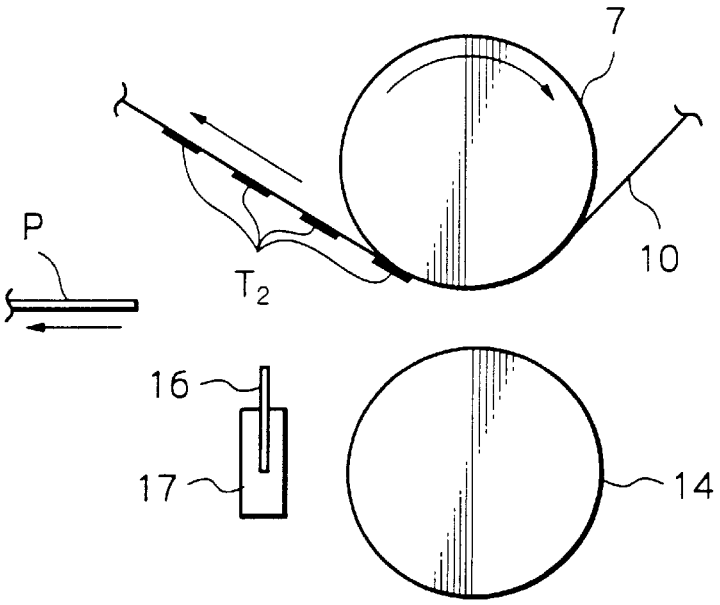
FIG. 9 is a view for describing why pattern toner images are scattered by the discharge of the discharge needle.

Assume that the voltage is continuously applied to the discharge needle 16 even in the condition shown in FIG. 9. Then, the discharge from the discharge needle 16 scatters the toner of the pattern toner images $T_2$ and prevents the sensor 22 from accurately sensing the densities of the images $T_2$. Moreover, if the discharge from the needle 16 deposits an extra negative charge on the pattern toner images $P_2$, then the cleaning member 21, FIG. 3, cannot easily remove the images $P_2$ due to the resulting excessive charge.

In light of the above, in the illustrative embodiment, the voltage application to the discharge needle 16 is interrupted before the pattern toner images $T_2$ reach a position where the image transfer roller 14 and belt 10 contact each other or are closest to each other. This configuration protects the pattern toner images $T_2$ on the belt 10 from the influence of the discharge of the needle 16 and thereby obviates the scattering or the excessive charging of the toner. The sensor 22 can therefore accurately sense the densities of the pattern toner images $T_2$. In addition, the cleaning member 21 is free from heavy loads.

Figure 10:
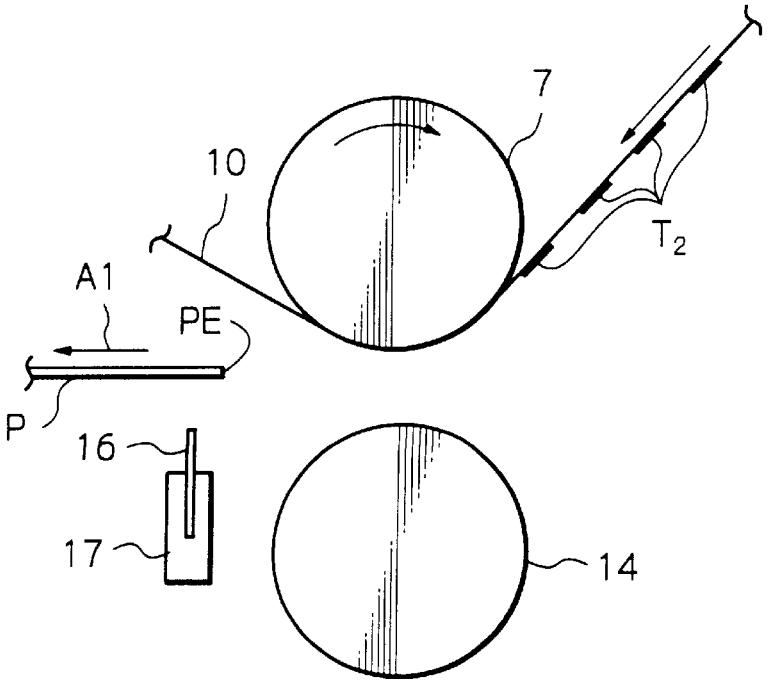
FIG. 10 is a view showing another specific timing for interrupting the application of an image transfer voltage to an image transfer roller.
Figure 11:
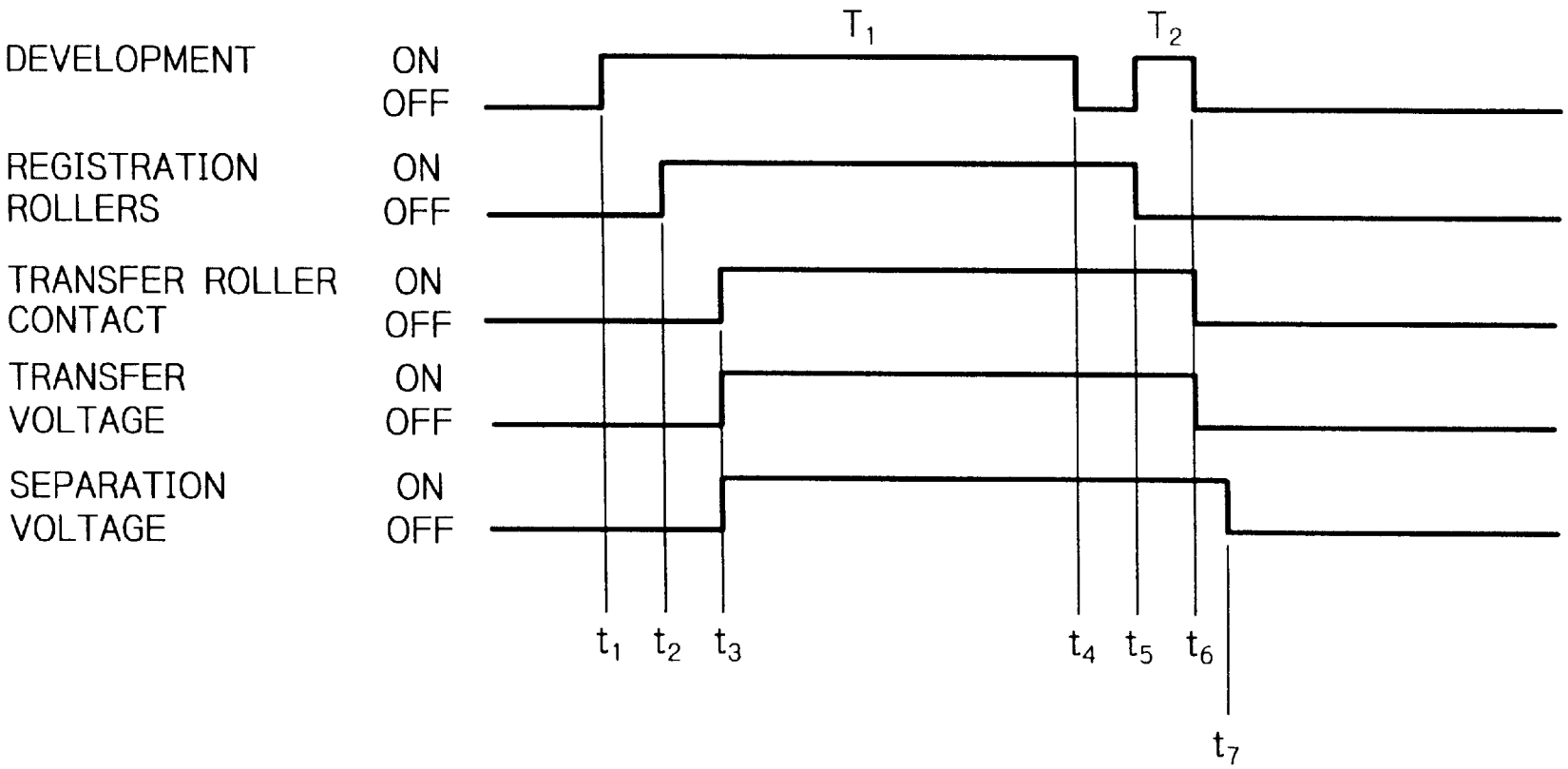
FIG. 11 is a timing chart demonstrating a specific operation of the alternative embodiment.

FIGS. 10 and 11 are representative of another specific procedure capable of replacing the procedure of FIG. 5 in which the voltage application to the image transfer roller 14 and the voltage application to the discharge needle 16 are interrupted at the same time. As shown, after the trailing edge PE of the paper P has moved away from the image transfer region, but before the voltage application to the discharge needle 16 is interrupted at a time $t_7$, the roller 14 is released form the belt 10 while the voltage application to the roller 14 is interrupted.

Specifically, as shown in FIGS. 5 and 8, assume that the voltages assigned to the needle 14 and roller 14 are interrupted at the same time with the roller 14 beginning to be released from the belt 10. Then, if the distance between the roller 14 and the pattern toner images $T_2$ is not great at the time of voltage application to the roller 14, as shown in FIG. 8, the roller 14 is apt to attract the images $T_2$ due to the electric field and cause the toner of the images $T_2$ to fly about or to smear the roller 14. To solve this problem, it is necessary to provide a great distance between the pattern toner images $T_2$ and the full-color toner image on the belt 10. This, however, brings about a problem that in an operation for continuously transferring toner images to a plurality of papers, the interval between consecutive sheets increases and lowers the image forming speed.

By contrast, as shown in FIGS. 10 and 11, assume that the voltage application to the roller 14 is interrupted earlier than the interruption of the voltage application to the discharge needle 16. Then, even if the distance between the full-color toner image and the pattern toner images $T_2$ is reduced (see FIG. 10), the voltage application to the roller 14 has already been interrupted when the images $T_2$ approach the roller 14. This successfully solves the problems stated above. In this manner, the configuration of FIGS. 10 and 11 allows the interval between consecutive sheets to be reduced in a continuous image forming mode operation and thereby increases the image forming speed.

In summary, it will be seen that the present invention provides an image forming apparatus and an image transferring device therefor simple in construction and low cost and capable of preventing the trailing edge of a recording medium from noticeably jumping up and causing a toner image to contact a structural element included in the apparatus. Further, toner forming pattern toner images is prevented from flying about. In addition, the interval between consecutive recording media can be reduced during continuous image forming mode operation in order to increase the image forming speed available with the apparatus.

Various modifications will become possible for those skilled in the art after receiving the teachings of the present disclosure without departing from the scope thereof.

What is claimed is:

1. An image transferring device comprising:

an image carrier;

an image carrier moving mechanism configured to move the image carrier along a path;

a pair of image transfer members sandwiching the image carrier and forming a nip between said pair of image transfer members at an image transfer position on said path;

a recording medium moving mechanism configured to move recording medium into said nip for transfer of an image from said carrier to said recording medium at said image transfer position;

a discharger configured to supply a charge suitable to provide separation of said recording medium from said image carrier at a separating position adjacent to a linear portion of said path along which a surface of said image carrier is caused to move by said image carrier moving mechanism after leaving said nip;

a power source configured to apply a voltage to said discharger; and a controller configured to cause said power source to continuously apply the voltage to said discharger from at least the time the recording medium is moved into said nip by said recording medium moving mechanism until a trailing edge of the recording medium is moved away from said separating position by said recording medium moving mechanism.

2. An image forming apparatus comprising:

a latent image carrier;

latent image forming means for forming a latent image on said latent image carrier;

developing means for developing the latent image to thereby produce a corresponding toner image;

an intermediate image transfer body to which the latent image is transferred from said latent image carrier;

an intermediate image transfer body moving means for moving the intermediate image transfer body along a path;

first image transferring means at a first position along said path for transferring the toner image from said latent image carrier to said intermediate image transfer body;

a recording medium moving means for moving a recording medium;

second image transferring means at a second position along said path for transferring the toner image from said intermediate image transfer body to said recording medium, said second image transferring means including a pair of image transfer members sandwiching said intermediate image transfer body and forming a nip between said pair of image transfer members, said recording medium moving means moving said recording medium into said nip at said second position along said path;

a discharge means for providing a charge suitable for separating the recording medium from said intermediate image transfer body at a separating position adjacent to a linear portion of said path along which a surface of said intermediate image transfer body is moved by said intermediate image transfer body moving means after leaving said nip;

a power source for applying a voltage to said discharge means; and control means for causing said power source to continuously apply the voltage to said discharge means from at least the time the recording medium is moved into said nip by said recording medium moving means until a trailing edge of the recording medium is moved away from said separating position by said recording medium moving means.

3. An image forming apparatus comprising:

a latent image carrier;

a latent image carrier moving means for moving said latent image carrier along a path;

a latent image forming means for forming a latent image on said latent image carrier at a first position along said path;

developing means at a second position along said path for developing the latent image to thereby produce a corresponding toner image;

recording medium moving means for moving a recording medium; and image transferring means for transferring the toner image from said latent image carrier to said recording medium at an image transferring position along said path, said image transferring means comprising, a pair of image transfer members sandwiching said latent image carrier and forming a nip between said pair of image transfer members at said image transferring position, said recording medium moving means moving said recording medium into said nip;

a discharge means for providing a suitable charge for separating the recording medium from said latent image carrier at a separating position adjacent to a linear portion of said path along which a surface of said latent image carrier is moved by said latent image carrier moving means after leaving said nip, a power source for applying a voltage to said discharge means, and control means for causing said power source to continuously apply the voltage to said discharge means from at least the time the recording medium is moved into said nip until a trailing edge of the recording medium is moved away from said separating position by said recording medium moving means.

4. An image forming apparatus comprising:

an image carrier having a surface movable while carrying a toner image thereon;

a recording medium moving means for moving a recording medium into an image transferring position relative to said image carrier;

image transferring means applying an image transfer voltage opposite in polarity to a charge deposited on the toner image for electrostatically transferring said toner image from said image carrier to said recording medium moved to said image transferring position by said recording medium moving means;

separating means applying a separation voltage of a same polarity as the charge of the toner image for discharging or reducing a charge deposited on the recording medium by said image transferring means, said separating means being positioned adjacent to a straight line portion of a path taken by the image carrier after leaving the image transferring position to provide separation of said recording medium from the surface of said image carrier; and separation voltage control means for controlling application of the separation voltage to said separating means such that said application is interrupted after a trailing edge of the recording medium has reached a position adjacent to said separating means.

5. An apparatus as claimed in claim 4, further comprising a sensor for sensing a density of a pattern toner image formed on the surface of said image carrier upstream of the toner image in a direction of movement of the surface of said image carrier, said separation voltage control means controlling the application of the separation voltage such that said application is interrupted before said pattern toner image arrives at a position where said image transferring means and said image carrier face each other.

6. An apparatus as claimed in claim 5, further comprising transfer voltage control means for controlling an application of the image transfer voltage to said image transferring means such that said application is interrupted after the trailing edge of the recording medium has moved away from an image transfer region where a transfer of the toner image to said recording medium is effected by said image transferring means, but before the application of the separation voltage to said separating means is interrupted.

* * * * *